US006036245A

United States Patent [19]

Schaefer

[11] Patent Number: 6,036,245

[45] Date of Patent: Mar. 14, 2000

[54] PIVOTAL GATE LATCH

[75] Inventor: Alan W. Schaefer, St. Genevieve County, Mo.

[73] Assignee: The Latch L.L.C., Bloomsdale, Mo.

[21] Appl. No.: 09/041,587

[22] Filed: Mar. 12, 1998

Related U.S. Application Data

[60] Provisional application No. 60/040,975, Mar. 14, 1997.

[51] Int. Cl.[7] ..... E05B 15/02

[52] U.S. Cl. ..... 292/341.17; 292/207; 292/119

[58] Field of Search ..... 292/341.17, 216, 292/213, 341.15, 116, 119, 106, 340, 207

[56] References Cited

U.S. PATENT DOCUMENTS

| | | | |
|---|---|---|---|
| 861,406 | 7/1907 | Stetler | 292/216 |
| 1,168,234 | 1/1916 | Tausch | 292/216 |
| 1,280,653 | 10/1918 | Brady | 292/216 |
| 1,538,056 | 5/1925 | Olson | 292/213 |
| 1,711,743 | 5/1929 | Olson | 292/216 |
| 1,896,909 | 2/1933 | Maxwell | 292/341.17 |
| 2,666,660 | 1/1954 | Youngworth | 292/68 |
| 3,877,738 | 4/1975 | Nelson | 292/68 |
| 3,907,345 | 9/1975 | Martini | 292/68 |
| 3,953,004 | 4/1976 | Schmidt et al. | 259/23 |
| 4,062,575 | 12/1977 | Robins | 292/67 |
| 4,083,591 | 4/1978 | Parisien | 292/202 |
| 4,111,475 | 9/1978 | McCormick et al. | 292/216 |
| 4,135,747 | 1/1979 | Melilli | 292/175 |
| 4,167,281 | 9/1979 | Spencer | 292/216 |
| 4,198,085 | 4/1980 | Schacter | 292/217 |
| 4,226,450 | 10/1980 | Kerr | 292/59 |
| 4,254,975 | 3/1981 | Miller | 292/264 |
| 4,333,673 | 6/1982 | Kerr | 292/59 |
| 4,371,200 | 2/1983 | Porter | 292/99 |
| 4,387,916 | 6/1983 | Lening et al. | 292/5 |
| 4,451,072 | 5/1984 | Petty, Sr. | 292/128 |
| 4,778,205 | 10/1988 | Sayre | 292/171 |
| 4,799,720 | 1/1989 | Watson et al. | 292/299 |
| 4,923,231 | 5/1990 | Bergman et al. | 292/238 |
| 4,938,508 | 7/1990 | Thomas | 292/235 |
| 5,103,658 | 4/1992 | McQuade | 70/77 |
| 5,104,164 | 4/1992 | Sieg | 292/336.3 |
| 5,275,450 | 1/1994 | Winter | 292/204 |
| 5,284,370 | 2/1994 | Dunn | 292/68 |
| 5,358,292 | 10/1994 | Van Weibe et al. | 292/235 |
| 5,476,133 | 12/1995 | Torkelson | 160/328 |
| 5,498,041 | 3/1996 | Bezzerides et al. | 292/225 |
| 5,593,141 | 1/1997 | Cain et al. | 256/26 |

*Primary Examiner*—Darnell M. Boucher
*Assistant Examiner*—Clifford B Vaterlaus
*Attorney, Agent, or Firm*—Paul M. Denk

[57] ABSTRACT

A pivotal gate latch (1), including housing (2), in which a pivotal sleeve (8) and gate post embracing plates (9 and 10) are disposed for pivotal movement. A latching flange (11) is arranged within the housing that engages with an upper disposed detent or shoulder (21) formed in the pivotal sleeve, to secure the gate frame (P) in place and sustain it in a locked condition. Vertical displacement of the latching flange, either manually or through remote cables, permits horizontal pivoting the latch plates in either direction, after which time, if the gate is biased by associated springs or cables, the gate may be self-centering, and locked automatically by the return of the latching flange to the rest position within the shoulder.

6 Claims, 5 Drawing Sheets

PIVOTAL GATE LATCH

CROSS-REFERENCE TO RELATED APPLICATIONS

Priority date from provisional U.S. patent application Ser. No. 60/040,975 filed Mar. 14, 1997.

STATEMENT REGARDING FEDERALLY SPONSORED RESEARCH OR DEVELOPMENT

Not Applicable.

BACKGROUND OF THE INVENTION

This invention relates to self-locking gate latches, and more specifically, to a pivotal gate latch for use in conjunction with a pivotal gate, that normally, when closed, secures to an adjacent post, but which may be pivoted in opposite directions for opening and, when aligned into closure, becomes fixed to prevent ingress and egress.

A variety of latching means for use in conjunction with a pivoting gate, and its adjacent gatepost, have been available in the art. Normally, these latching devices incorporate rather complex structures arranged internal to the gatepost to which the gate latch affixes and, as a result, generally require their being built into the structure of the post for installation and operation. For example, the U.S. Pat. No. 5,284,370 to Dunn shows a pivotal gate latch which affixes directly to a metallic gatepost, in which the operating components must be installed during assembly. Similarly, U.S. Pat. No. 5,103,658 to McQuade shows a related type of self-locking gate latch. The McQuade latch, distinguished from the Dunn latch, includes its operating components assembled within a housing, and the housing itself affixed to a metallic gatepost. A drawback to the McQuade design is the singular design of the fork latching means. Affixed to an individual upstanding oarlock shaft, the latching mechanism is off-center, or elevated from the operating components, and therefore is prone to early fatigue due to repeated usage.

Additional United States patents disclose a variety of self-locking gate latch mechanisms. Exemplary devices may be seen in U.S. Pat. No. 5,498,041 to Bezzerides, et al.; U.S. Pat. No. 5,476,133 to Torkelson; U.S. Pat. No. 5,358,292 to VanWiebe, et al.; U.S. Pat. No. 5,284,370 to Dunn; U.S. Pat. No. 5,275,450 to Winter; U.S. Pat. No. 5,104,164 to Palmer, Jr.; U.S. Pat. No. 5,103,658 to McQuade; U.S. Pat. No. 4,938,508 to Thomas; U.S. Pat. No. 4,923,231 to Bergman, et al.; U.S. Pat. No. 4,799,720 to Watson, et al.; U.S. Pat. No. 4,778,205 to Sayer; U.S. Pat. No. 4,451,072 to Petty, Sr.; U.S. Pat. No. 4,387,916 to Lening, et al.; U.S. Pat. No. 4,371,200 to Porter; U.S. Pat. No. 4,333,673 to Kerr; U.S. Pat. No. 4,226,450 to Kerr; U.S. Pat. No. 4,254,975 to Miller; U.S. Pat. No. 4,198,085 to Schacter; U.S. Pat. No. 4,167,281 to Spencer; U.S. Pat. No. 4,135,747 to Melilli; U.S. Pat. No. 4,111,475 to McCormick; U.S. Pat. No. 4,083,591 to Parisien; U.S. Pat. No. 4,062,575 to Robins; and U.S. Pat. No. 3,953,064 to McHenry.

BRIEF SUMMARY OF THE INVENTION

Among the several objects and advantages of the present invention are:

The provision of the aforementioned pivotal gate latch which is to provide the simple application of a locking flange to a detent integrally formed on a pivotal latch, in order to fix and lock the latch into a gate holding position, and which can be easily raised to allow the pivotal latch to pivot bi-directionally to allow the gate to swing either inward or outward, yet be automatically latched when the gate is aligned into closure;

The provision of the aforementioned pivotal gate latch which automatically catches and locks the gate, regardless that the gate may swing in either direction;

The provision of the aforementioned pivotal gate latch which may be operated remotely, through the disposition of cables and the like;

The provision of the aforementioned pivotal gate latch which is of unique construction, and retains its functionality even when exposed to very inclement weather;

The provision of the aforementioned pivotal gate latch which is of sturdy construction, fabricated entirely of metallic components, and can be subjected to rugged wear and tear during its useful life; and The provision of a pivotal gate latch which is fabricated of a minimum of components, and can sustain a long and useful life during its installation.

Briefly stated, the pivotal gate latch of this invention is of the type that may be quickly mounted to a post to freely pivot in either direction, except during that instance when the latch is centered and embraces a gate, fixing it into a locked position. The latching mechanism only includes two moving parts, a pivoting latch mechanism and a locking flange which is raised when the gate latch is to be disconnected, allowing latch mechanism to pivot, or lowered by gravity to secure the latch mechanism into a centered and locked position.

The latch mechanism of this invention is simply embodied within a housing. During installation, the housing may be mounted vertically to a fixed gate post, such as a wooden 4"×4" or 6"×6" post, or bolted onto a metal post. The locking flange incorporates any form of an actuating means designed to facilitate gripping by an operator when it is desired to release the locking flange from the locked position. Releasing the locking flange from the locked position raises the locking flange above a detent or shoulder operatively associated with the pivotal latch, so that the pivotal latch is free to pivot bi-directionally about a vertical axis, allowing the associated gate to swing either inward or outward. Once the handle of the locking flange is released from the raised position, and the gate is swung back into closure, the gate encounters the pivotal latch of the lock, and shifts it into a centralized alignment, at which time the locking flange drops into engagement within the detent or shoulder, securing the latch and gate in the central locked position. Thus, there are only two moving parts to the pivotal gate latch in addition to its housing mount, and therefore, few components subject to wear-out, sustaining the long and useful life of the pivotal gate latch.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description will clearly enable one skilled in the art to make and use the invention, describes several embodiments, adaptations, variations, alternatives, and uses of the invention, including what we presently believe is the best mode of carrying out the invention.

Figure 1:
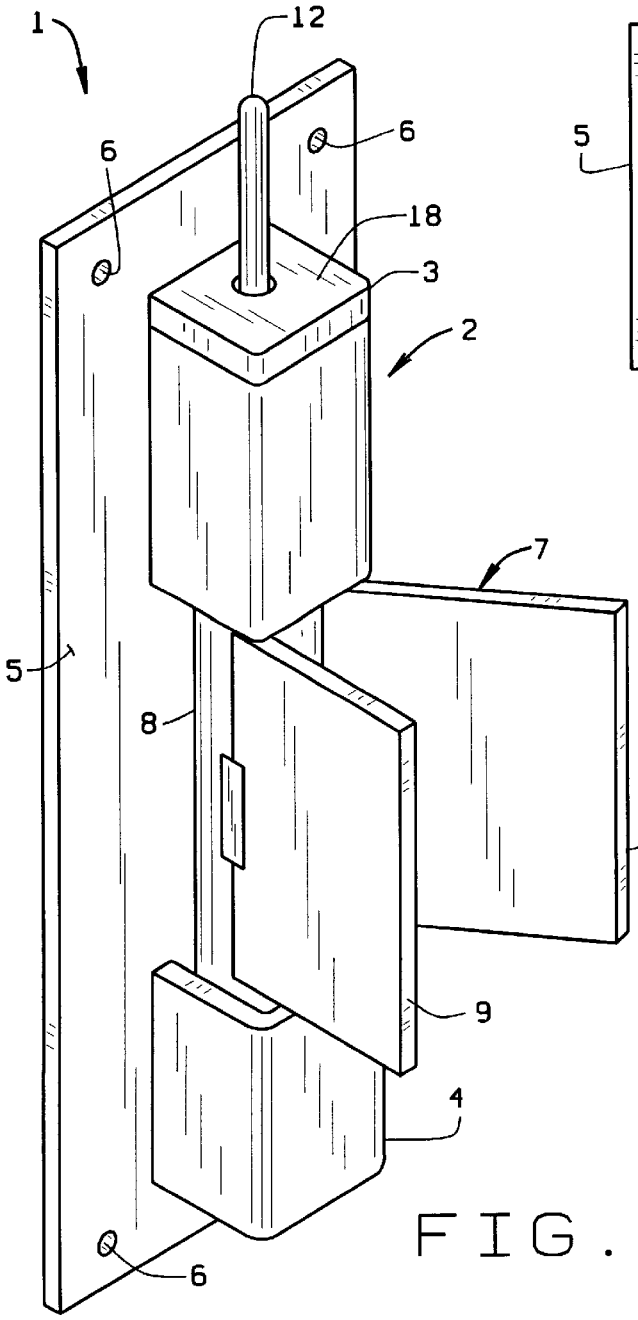
FIG. 1 is an isometric view of the pivotal gate latch of the present invention.

In referring to the drawings, and in particular FIG. 1, a pivotal gate latch 1 of the present invention is disclosed. The pivotal gate latch includes a housing 2, formed as a pair of upper and lower brackets 3 and 4, which are affixed, by weld or other means, to a base plate 5. The base plate 5 has a series of apertures provided therethrough, as at 6, through which various fasteners such as bolts or screws (not shown) may be inserted for securing the housing 2 directly to a fixed gate post.

Operatively located within the housing 2, a pivotal latch 7 is retained by the upper and lower brackets 3 and 4. The pivotal latch comprises a cylindrical pivotal sleeve 8 passing through the upper and lower brackets, and a pair of plates 9 and 10, affixed, by weld or other means, to the portion of the pivotal sleeve located between the brackets. Plates 9 and 10 abut both the upper and lower brackets, substantially preventing vertical displacement of the pivotal latch 7 within the housing 2.

Figure 3:
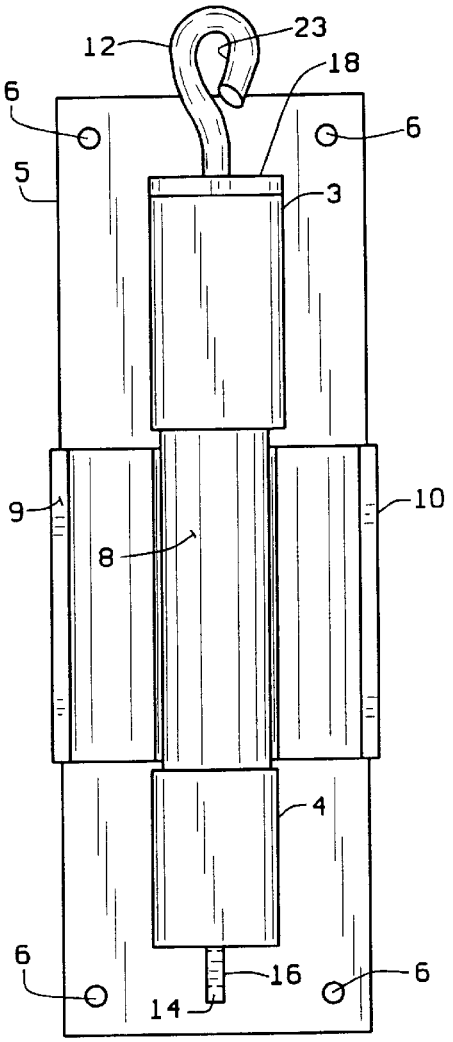
FIG. 3 is a front view of the pivotal gate latch of FIG. 1.
Figure 5:
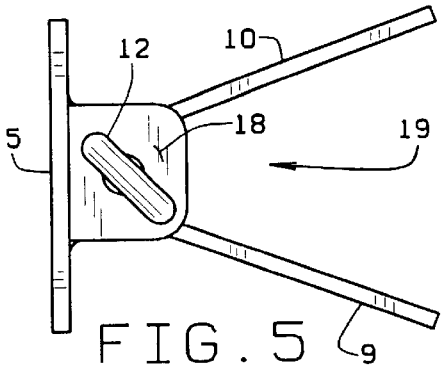
FIG. 5 is a top plan view thereof.
Figure 4:
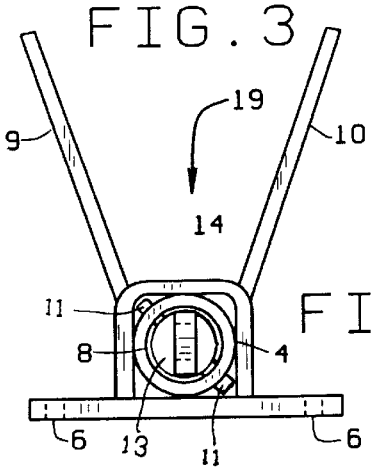
FIG. 4 is a bottom plan view thereof.
Figure 8A:
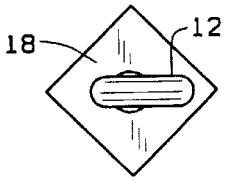
FIG. 8A is a top plan view of the locking flange of FIG. 8.
Figure 8:
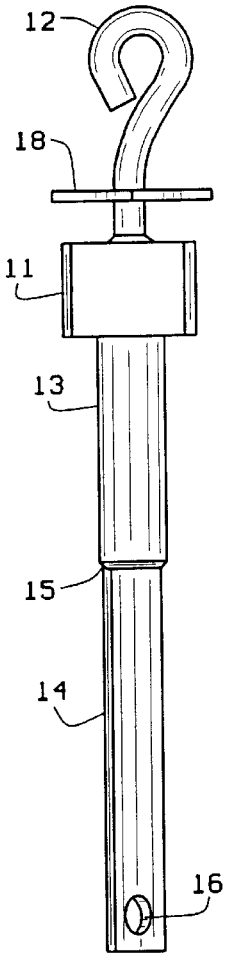
FIG. 8 is a view of the locking flange and pin that fits within the housing and the pivotal latch.
Figure 8B:
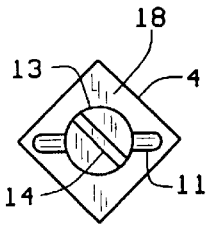
FIG. 8B is a bottom view of the locking flange and pin of FIG. 8.

Also provided within the housing 2 is a latching flange 11, best seen in FIGS. 8 through 8B. The latching flange 11 is slightly smaller in width than a horizontal inner diagonal measurement of bracket 3, such that the latching flange may be vertically displaced within said bracket 3, but is restrained from rotational movement. An actuating member 12, comprising a ring or handle, is secured to the top of the latching flange 11, and beneath the flange is a cylinder or rod 13, which has an external diameter just slightly less than the internal diameter of the pivotal sleeve 8, so as to provide for a snug coaxial locating of the cylinder or rod 13 therein. Extending downwardly from the cylinder 13 is a bar 14, the bar at its upper edge, as at 15, being integrally connected with the sleeve 13, while the lower end, including an aperture 16. The length of bar 14 is such that the bar extends through and out of the lower bracket 4, so that any type of a latch pin or other locking means may be secured through the aperture to prevent vertical displacement of the latching flange and opening of the gate latch. The extension of the bar 14, and its integral aperture 16, below the bracket 4, can be better seen in FIG. 3.

In an alternate embodiment, cylinder or rod 13 is dispensed with, and bar 14 is extended to the latching flange 11, which is secured at an angle to the rear face of the bar. In this alternate embodiment, the width of bar 14 is sufficient to prevent excessive lateral movement when positioned coaxially within the pivotal sleeve 8, without hindering the rotational movement of the sleeve relative to the bar, or vertical displacement of the bar.

Figure 7:
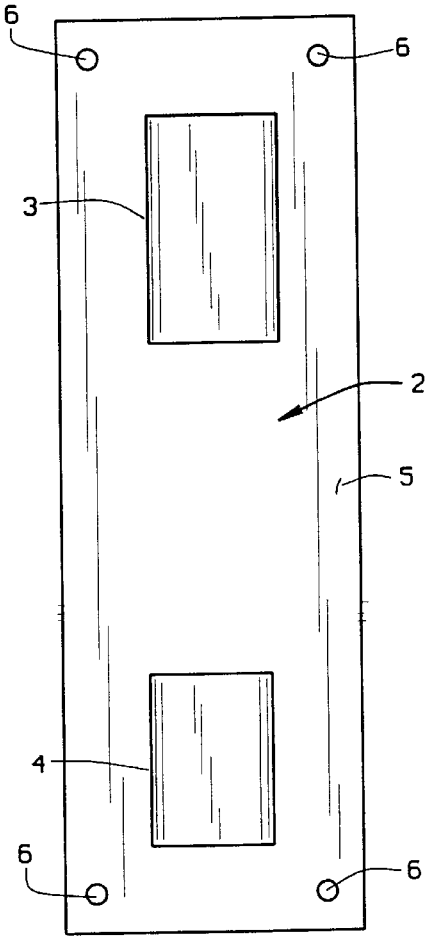
FIG. 7 is a back view of the pivotal gate latch of FIG. 6.
Figure 7A:
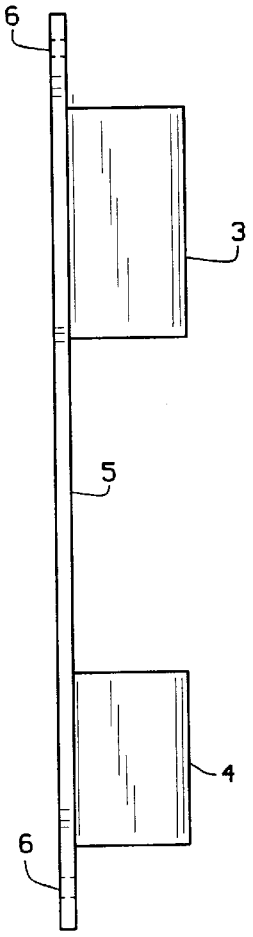
FIG. 7A is a side view of the housing of the pivotal gate latch.
Figure 7B:
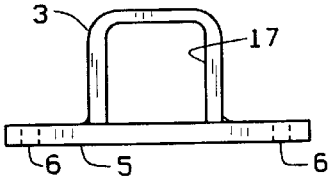
FIG. 7B is a top plan view thereof.

Housing 2 for the latch is also shown in FIGS. 7 through 7B. The housing includes the upper bracket 3 and the lower bracket 4 secured to the mounting plate 5, as previously explained. The upper and lower brackets 3 and 4 have adequate clearance, as at 17, provided therethrough, and into which the pivotal sleeve 8 of the pivotal latch 7 is positioned during assembly. Next, latch plates 9 and 10 are secured to the portion of the pivotal sleeve located between the upper and lower brackets, preventing further vertical displacement of the sleeve relative to the housing 2. After assembly of the pivotal latch 7 within the housing 2, the pin means 11 is inserted coaxially downwardly through the pivotal sleeve 8, such that an upper closure plate 18 fitted around the actuating member, above the latching flange (see FIG. 8), comes to rest upon an upper edge 19 of the upper bracket 3. The upper closure plate 18 is secured to the upper bracket by weld or other means, to provide for complete closure of the assembled pivotal gate latch 1. The upper closure plate 18 further serves as a stop to prevent excessive vertical displacement and rotational movement of the latching flange.

Figure 2:
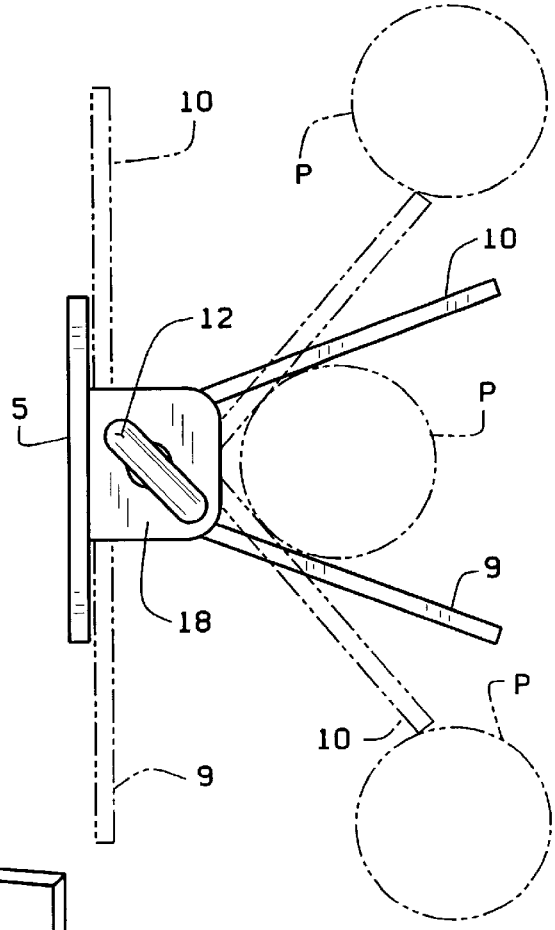
FIG. 2 is a top plan view of the pivotal gate latch, showing in phantom the latch means pivoted in either direction to provide for the swing opening of an adjacent gate to either an inwardly or outwardly opened position.
Figure 9B:
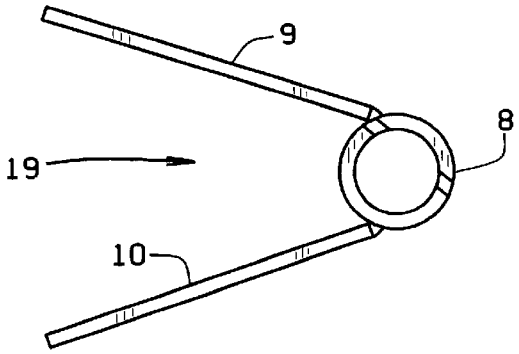
FIG. 9B is a top plan thereof.
Figure 9:
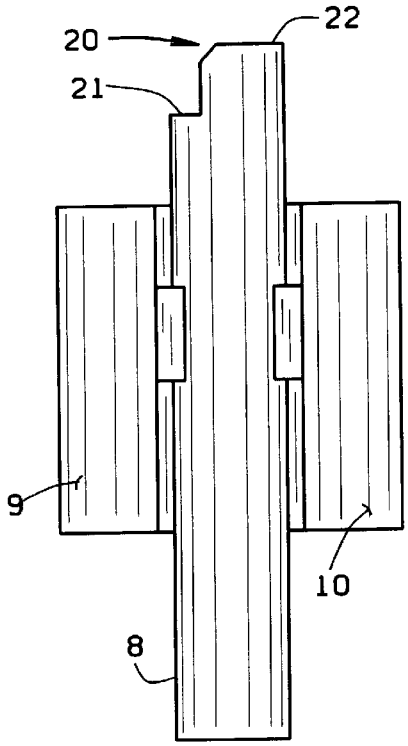
FIG. 9 is a front view of the pivotal locking flange.
Figure 9A:
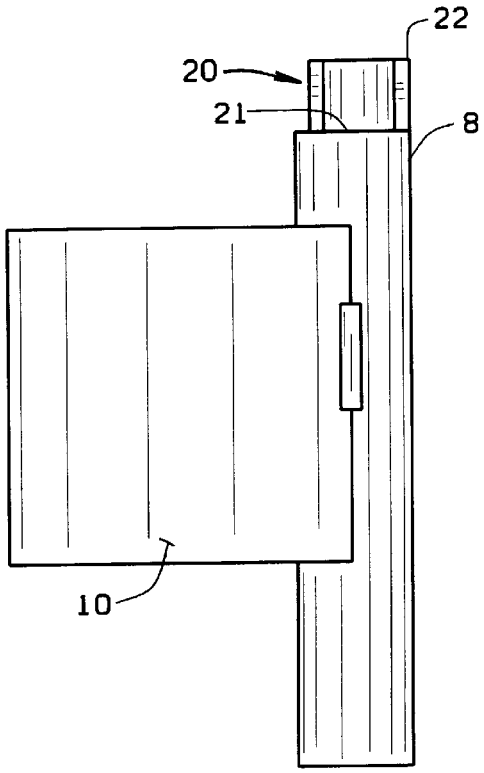
FIG. 9A is a side view thereof.
Figure 9C:
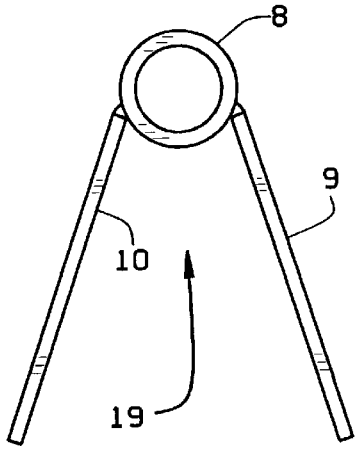
FIG. 9C is a bottom plan view thereof.

The specific structure of the latching mechanism is best seen in FIGS. 9 through 9C. As shown, the pivotal sleeve 8 includes sufficient length to provide for placement within the upper and lower brackets 3 and 4, and for the securement of the locking plates 9 and 10 to the outer surface of the sleeve between the brackets. Plates 9 and 10 are secured to the sleeve in a divergent angular relationship, configured to provide adequate space therebetween, as seen at 19 in FIGS. 9B and 9C, in order to embrace the adjacent frame P of a pivotal gate, as can be seen in FIG. 2. The upper edge of the pivotal sleeve 8, is notched, as at 20, so as to have a angled detent or cut-out shoulder 21, and an upwardly extending partial sleeve 22.

Figure 6:
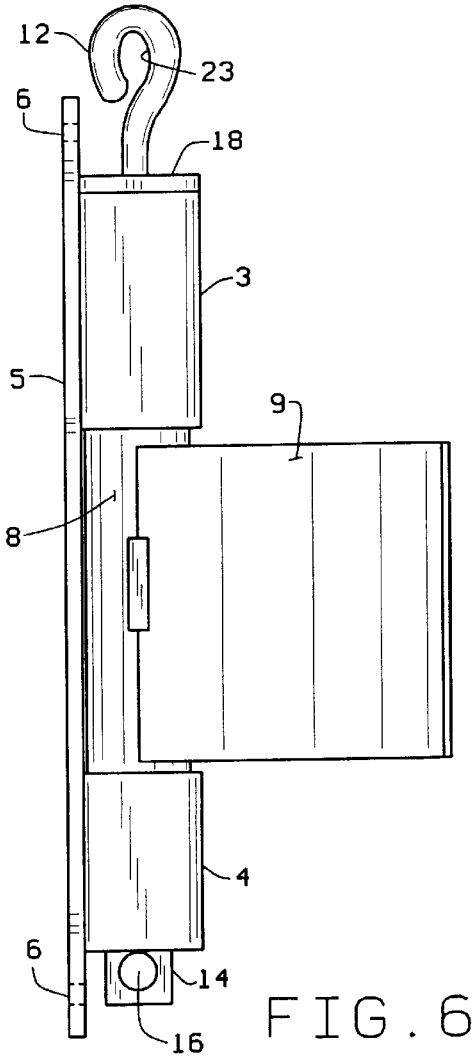
FIG. 6 is a side view thereof.
Figure 6A:
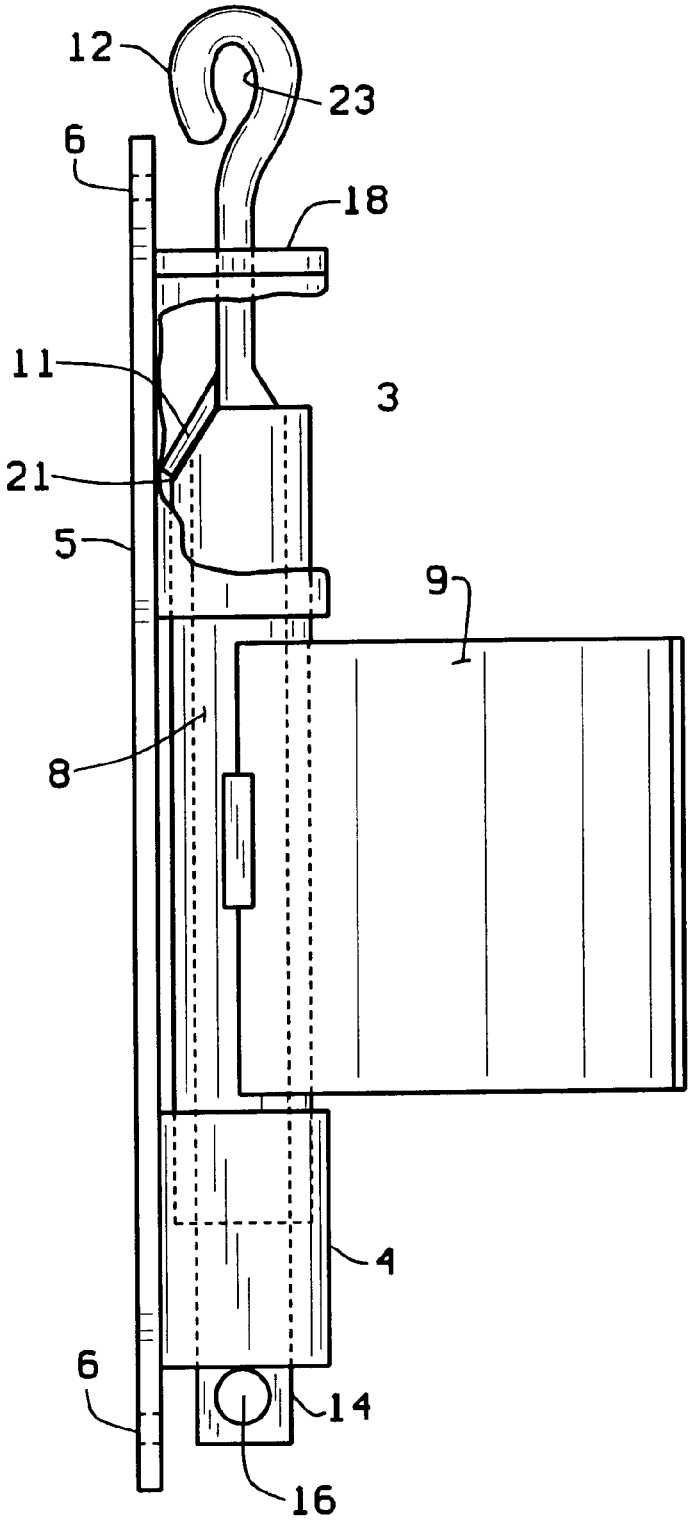
FIG. 6A is a cut-away side view, illustrating the locking interaction of the locking flange and the pivotal latch.

It is into the angled detent or cut-out shoulder 21 that the locking flange 11 inserts, in the form of a detent connection, to lock the gate into its closed position, where the plates 9 and 10 extend radially outwardly from the plate 5, and embrace the gate frame P into a fixed position, as can be seen in FIG. 2. When the locking flange is raised within the sleeve 8, so as to displace the locking flange 11 above the upper edge 22 of the sleeve detent 21, the latching plates 9 and 10, in conjunction with the pivotal sleeve 8, are free to pivot in either direction, as can be seen in FIG. 2, and thereby release the gate frame P for bi-directional pivotal opening. In the raised position, the locking flange 11 seats upon the upper edge 22 of the sleeve 8, remaining in the raised position until the gate frame P pivots back towards its closed location, in perpendicular alignment with the pivotal latch 1, and the plates 9 and 10 move into the central location as shown in the solid line of FIG. 2, at which time the flange 11 realigns with the angled detent or cut-out shoulder 21 of the sleeve 8, and drops into the detent connection, as seen in the cut-away portion of FIG. 6A.

The range of rotational motion of pivotal sleeve and latching plates is restrained between 90° and 180° of displacement, by the interference of latching plate 9 with the base plate 5 on one side, and the corresponding interference of latching plate 10 with the base plate on the opposite side. One skilled in the art will recognize that the specific range of rotational motion is dependent upon the angular relationship between the latching plates, which is in turn dependent upon the width or diameter of the gate frame P. If the angular relationship is enlarged to accommodate a gate frame of greater width or diameter, the range of rotational movement will correspondingly decrease for the same displacement of the latch and gate.

Thus as can be readily understood, the gate, and its associated frame P, can be pivoted bi-directionally, either outwardly or inwardly, but when it is repivoted back into perpendicular alignment with the gate latch 1, the gate frame P will force the plates 9 and 10 into their central position, as shown in FIG. 2, at which time the latch re-locks, holding the gate in the fixed perpendicular position.

As is known in the art, the gate associated with the frame P may be self-centering, having biasing springs to either side in order to equalize into a closed position, so that the gate, once forcefully pivoted into an opened position, may, under its own force, repivot back into the closed position, automatically fitting between latch plates 9 and 10 into a locked position. Alternatively, a form of rope or weighted cable may connect with an eyelet portion 23 of the pin 12, and extend in either direction by means of pulleys to a remote accessible location, where the occupant may, simply pull the latch upward, and then move through the gate while holding the cable, to obtain automatic access therethrough. Once the cable is released, the locking flange will descend downwardly within the sleeve 8 due to the force of gravity, and when the gate and its frame P become self-centered, as shown in FIG. 2, provide for relocking without further manual participation.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

I claim:

1. A pivotal gate latch for use with a pivoting gate and fixed gate post, comprising:

a housing including upper and lower vertically aligned brackets, said housing adapted for attachment to said fixed gate post;

a pivotal latch member secured to said housing by said upper and lower brackets, said pivoting latch member adapted for retaining said pivoting gate;

a locking member seated within said upper bracket, coaxial with said pivoting latch member, said locking member extending above said upper bracket and below said lower bracket and having first and second positions, said locking member preventing pivotal movement of said pivoting latch member in said first position, and permitting unrestrained pivotal movement of said pivoting latch member in said second position;

said pivoting latch member comprising a cylindrical sleeve, said sleeve having upper and lower faces, and an outer cylindrical surface, said sleeve of sufficient length to seat within said upper and lower vertically aligned brackets;

a first latch plate secured on a peripheral edge of said outer cylindrical surface;

a second latch plate secured on the peripheral edge of said outer cylindrical surface apart from, and horizontally aligned with, said first latch plate;

said first and second latch plates divergently aligned to retain said pivoting gate when said latch member is in said first position, said latch plate extending laterally and exteriorly between said upper and lower brackets;

said cylindrical sleeve further includes a shoulder formed in said upper face, said shoulder adapted to receive said locking member in said first position;

a locking flange of sufficient width to prevent rotation of said locking member within said upper bracket;

a bar having upper and lower ends, the upper end of said bar secured to a peripheral edge of said locking flange, and said bar of sufficient length to extend above said lower bracket;

an actuating member secured to the upper end of said bar, said actuating member extending above said upper bracket;

said locking member further includes a tubular sleeve secured around said bar below said locking flange, said tubular sleeve having an outer diameter smaller than an inner diameter of said cylindrical sleeve, such that said tubular sleeve seats coaxially within said cylindrical sleeve;

said locking flange being configured to seat within said shoulder in said first position and secure said cylindrical sleeve against pivotal movement;

said locking flange being configured to abut said upper face of said cylindrical sleeve in said second position, and disposing said cylindrical sleeve unrestrained against pivotal rotation;

said first position of said locking member is a rest position, and said second position of said locking member is an upward vertically displaced position;

said pivotal gate latch further including a closure plate, said closure plate secured to the upper face of said upper bracket, said closure plate providing closure for the upper edge of said upper bracket, said closure plate including an axial opening therein through which said locking means passes, and said locking means constrained against rotational movement by said closure plate.

2. The pivotal gate latch of claim 1 said wherein actuating member comprises a ring.

3. The pivotal gate latch of claim 1 wherein said pivotaing latch member is capable of rotational movement through an arc greater than 90°.

4. The pivoting gate latch of claim 1 wherein said pivoting latch member is configured to retain said pivoting gate perpendicular to said housing when said locking member is in said first position.

5. The pivoting gate latch of claim 1 wherein said bar further includes an aperture adjacent said lower end, said aperture configured to receive a locking pin and prevent vertical displacement of said locking member.

6. The pivotal gate latch of claim 1 and wherein said locking flange is fixed extending downwardly at an acute angle with said bar.

* * * * *